US008081062B2

(12) United States Patent
Son et al.

(10) Patent No.: US 8,081,062 B2
(45) Date of Patent: Dec. 20, 2011

(54) TRANSMIT/RECEIVE ANTENNA SYSTEM HAVING OFFSET FEED POINTS FOR HIGH ISOLATION

(75) Inventors: Hae-Won Son, Daejeon (KR); Won-Kyu Choi, Daejeon (KR); Chan-Soo Shin, Daejeon (KR); Gil-Young Choi, Daejeon (KR); Cheol-Sig Pyo, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 67 days.

(21) Appl. No.: 12/088,567

(22) PCT Filed: Dec. 29, 2005

(86) PCT No.: PCT/KR2005/004644

§ 371 (c)(1),
(2), (4) Date: Aug. 21, 2008

(87) PCT Pub. No.: WO2007/037578

PCT Pub. Date: Apr. 5, 2007

(65) Prior Publication Data

US 2008/0309428 A1 Dec. 18, 2008

(30) Foreign Application Priority Data

Sep. 29, 2005 (KR) ..... 10-2005-0091562

(51) Int. Cl.
*G08B 25/10* (2006.01)
*H01Q 21/00* (2006.01)

(52) U.S. Cl. ..... 340/10.1; 340/572.7; 343/756; 333/117; 333/21 A

(58) Field of Classification Search ..... 333/21 A, 333/117; 343/756; 340/10.1, 572.7
See application file for complete search history.

(56) References Cited

U.S. PATENT DOCUMENTS 4,464,663 A 8/1984 Lalezari et al.
5,001,444 A * 3/1991 Salvan et al. ..... 333/135
5,594,233 A 1/1997 Kenneth et al.
(Continued)

FOREIGN PATENT DOCUMENTS

JP 10-209912 8/1998
(Continued)

OTHER PUBLICATIONS

Parker et al., "Dual Polarized Microstrip Ring Antenna with Good Isolation" Electronic Letters, vol. 34, No. 11, pp. 1043-1044, May 1998.

*Primary Examiner* — Benny Lee
(74) *Attorney, Agent, or Firm* — Rabin & Berdo, P.C.

(57) ABSTRACT

Provided is an antenna system with high isolation. The high-isolation antenna has transmission ports of a transmission antenna and reception ports of a reception antenna highly isolated from each other by using quadrature hybrid couplers. The antenna system includes: a transmission antenna having two feed points for transmitting signals; a reception antenna having two feed points for receiving signals; a transmission hybrid coupler which is connected to the two feed points of the transmission antenna and transmits transmission signals which have a phase difference of 90° with each other; and a reception hybrid coupler which is connected to the two feed points of the reception antenna and receives reception signals which have a phase difference of 90° with each other. The signals leaking from the two feed points of the transmission antenna to the two feed points of the reception antenna are offset.

18 Claims, 6 Drawing Sheets

U.S. PATENT DOCUMENTS

| | | | | |
|---|---|---|---|---|
| 6,378,774 | B1 | 4/2002 | Emori et al. | |
| 6,424,299 | B1 | 7/2002 | Cha et al. | |
| 6,603,391 | B1 | 8/2003 | Greeff et al. | |
| 2004/0183742 | A1 | 9/2004 | Goff et al. | |
| 2005/0156039 | A1 | 7/2005 | Carrender et al. | |
| 2007/0080809 | A1 * | 4/2007 | Lannon et al. | 340/572.7 |

FOREIGN PATENT DOCUMENTS

| | | |
|---|---|---|
| KR | 1998-0064806 | 10/1998 |
| KR | 2003-0044124 | 6/2003 |
| WO | 2004/023601 | 3/2004 |

* cited by examiner

TRANSMIT/RECEIVE ANTENNA SYSTEM HAVING OFFSET FEED POINTS FOR HIGH ISOLATION

BACKGROUND OF THE INVENTION

The present invention relates to an antenna with a transmission part and a receiving part separated from each other; and, more particularly, to a Radio Frequency Identification (RFID) reader antenna whose transmission ports and reception ports are highly isolated from each other by using a quadrature hybrid coupler.

Radio Frequency Identification (RFID) readers are used in diverse fields, such as material management and security, along with an RFID tag, or transponder. Generally, when an object with an RFID tag attached thereto is disposed in a read zone of the RFID reader, the RFID reader modulates an RF signal which has a predetermined carrier frequency and sends an interrogation to the RFID tag. Then, the RFID tag responds to the interrogation from the RFID reader.

In short, the RFID reader transmits an interrogating signal to the RFID tag by modulating a continuous electromagnetic wave, which has a predetermined frequency. Then, the RFID tag performs back-scattering modulation onto the electromagnetic wave transmitted from the RFID reader to return its own information stored in a memory inside the RFID tag.

Back-scattering modulation is to modulate the intensity or phase of a scattered electromagnetic wave when an RFID tag returns an electromagnetic wave outputted from an RFID reader after scattering. Herein, since the RFID tag simply performs the back-scattering modulation onto the electromagnetic wave transmitted from the RFID reader, the carrier frequency of the electromagnetic wave transmitted from the RFID to the RFID reader is the same as the carrier frequency of the electromagnetic wave transmitted from the RFID reader to the RFID tag.

An RF receiver of the RFID reader receives not only signals transmitted from the RFID tag, but also some transmission signals transmitted from an RF transmitter of the RFID reader due to leakage. Herein, since the two kinds of signals have the same carrier frequency, the RF receiver of the RFID reader cannot separate one from the other even with a filter.

Generally, the intensity of the transmission signals leaked out of the RF transmitter of the RFID reader is higher than that of the signals transmitted from the RFID tag. The leakage signals degrade the reception sensitivity of the RFID reader.

To reduce leakage power from the RFID transmitter of the RFID reader, suggested is a method of forming two radiating bodies, i.e., a transmission part and a reception part, respectively, in an RFID reader antenna, and disposing them apart from each other with wide space between them to thereby isolate the transmitting port and the receiving port from each other. The method, however, has a problem that the antenna becomes large due to the wide space between the two radiating bodies.

SUMMARY OF THE INVENTION

It is, therefore, an object of the present invention to provide an antenna in which transmission ports of a transmission antenna and reception ports of a reception antenna are isolated from each other by using a quadrature hybrid coupler.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, there is provided an antenna with a transmission part and a reception part highly isolated from each other, which includes: a transmission antenna having two feed points for transmitting signals; a reception antenna having two feed points for receiving signals; a transmission hybrid coupler which is connected to the two feed points of the transmission antenna and transmits transmission signals which have a phase difference of 90° with each other; and a reception hybrid coupler which is connected to the two feed points of the reception antenna and receives reception signals which have a phase difference of 90° with each other, wherein signals leaking from the two feed points of the transmission antenna to the two feed points of the reception antenna are offset.

In accordance with another aspect of the present invention, there is provided an antenna with a transmission part and a reception part highly isolated from each other, which includes: two radiating bodies for transmission and reception, respectively; and two hybrid couplers for dually feeding the radiating bodies, wherein signals leaking from two feed points of a transmission antenna to two feed points of a reception antenna are offset by each other.

The objects, features and advantages of the present invention will become apparent by the following descriptions with reference to the accompanying drawings. Accordingly, those of ordinary skill in the art to which the present invention pertains may easily implement the technological concept of the present invention. Also, when it is considered that detailed description on a related art may obscure the points of the present invention, the description will not be provided herein.

Meanwhile, the high-isolation antenna of the present invention can be applied to diverse kinds of antennas which require high isolation between a transmission part and a reception part, other than the RFID reader antenna. Hereinafter, however, the present invention will be described by taking an RFID reader antenna as an example of the antenna with high isolation between the transmission part and the reception part.

The present invention can highly isolate a transmission port and a reception port from each other by using a hybrid coupler.

Also, the present invention can reduce the size of an antenna by minimizing the space between a transmission antenna and a reception antenna.

BRIEF DESCRIPTION OF THE DRAWINGS

The above and other objects and features of the present invention will become apparent from the following description of the preferred embodiments given in conjunction with the accompanying drawings, in which.

DESCRIPTION OF THE PREFERRED EMBODIMENTS

Figure 1:
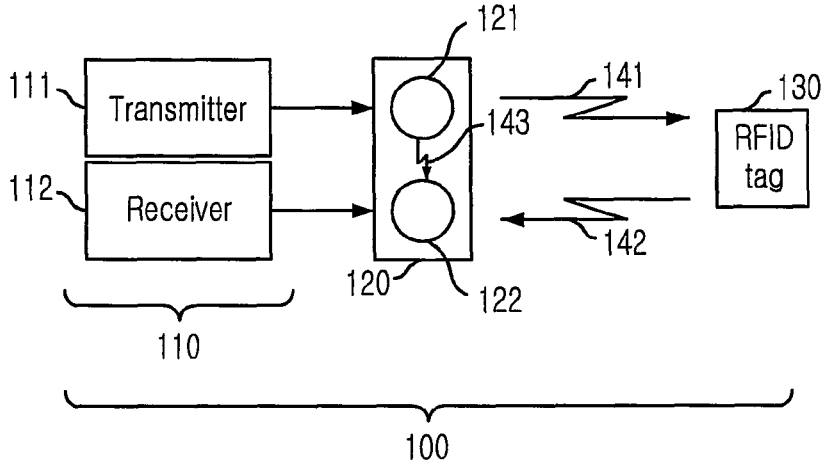
FIG. 1 is a block view illustrating a radio frequency identification (RFID) system to which the present invention is applied.

FIG. 1 is a block view illustrating a radio frequency identification (RFID) system to which the present invention is applied. The RFID system 100 of FIG. 1 includes an RFID reader 110, an RFID reader antenna (or antenna system) 120, which will be referred to as a reader antenna hereinafter, and an RFID tag 130. Herein, the RFID reader 110 includes an RF transmitter 111 and an RF receiver 112, which are electrically connected to a transmission radiating body (or antenna) 121 and a reception radiating body (or antenna) 122 of the reader antenna 120, respectively.

To have a look at the operation of the RFID system 100, the RFID reader 110 modulates RF signals having a predetermined carrier frequency and transmits an interrogation to the RFID tag 130. The RF signals generated in the RF transmitter 111 of the RFID reader 110 are transmitted in the form of an electromagnetic wave 141 through the transmission antenna 121 of the reader antenna 120.

When the electromagnetic wave 141 arrives at the RFID tag 130, the RFID tag 130 performs back-scattering modulation onto the electromagnetic wave 141 transmitted from the RFID reader 110 and reflects the back-scattering modulated electromagnetic wave back to the RFID reader 110 to thereby response to the interrogation of the RFID reader 110. The back-scattering modulated electromagnetic wave 142 reflected by the RFID tag 130 is transmitted to the RF receiver 112 of the RFID reader 110 through the reception antenna 122 of the reader antenna 120.

Meanwhile, the RF receiver 112 of the RFID reader 110 receives not only the back-scattering modulated electromagnetic wave 142 reflected by the RFID tag 130 but also some of the signals transmitted from the RF transmitter 111, representing transmission leakage. The leaked transmission signals 143 reduce reception sensitivity of the RFID reader 110 considerably. The leaked transmission signals 143 are mainly originated from the combination between the transmission antenna 121 and the reception antenna 122 of the reader antenna 120.

The present invention prevents the leakage of the transmission signals from the RF transmitter 111 to the RF receiver 112 by highly isolating the input ports of the transmission and reception radiating bodies in the RFID reader 110 from each other, which is described in FIG. 1.

Figure 2:
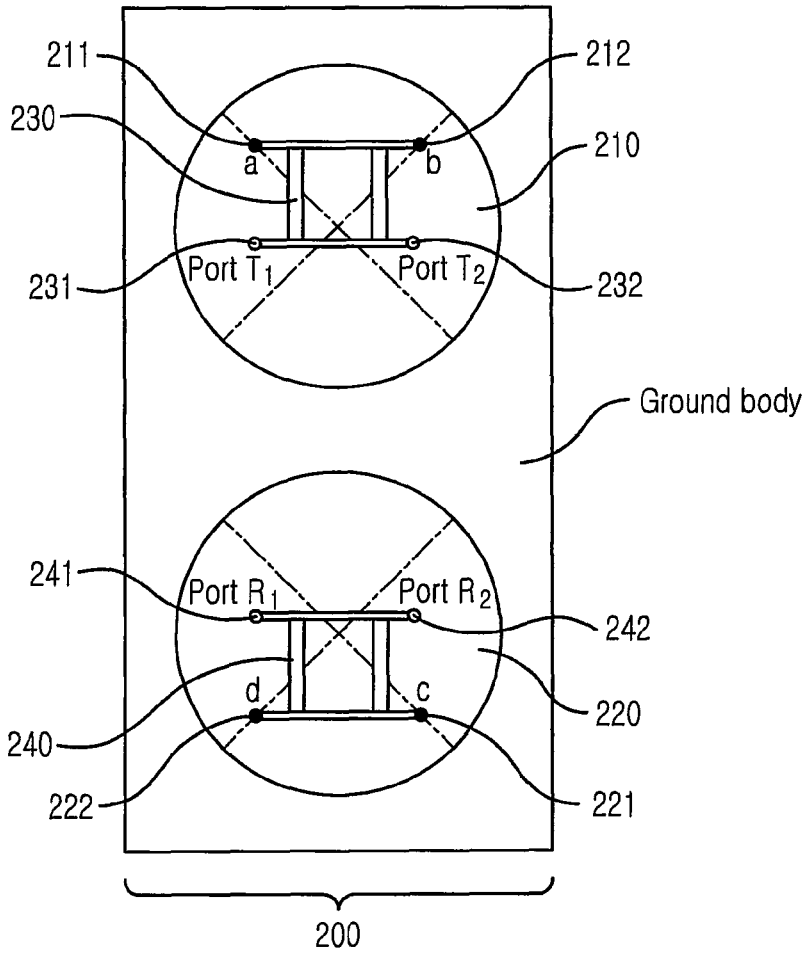
FIG. 2 is a schematic view illustrating an RFID reader antenna in accordance with an embodiment of the present invention.

FIG. 2 is a schematic view illustrating an RFID reader antenna 200 in accordance with an embodiment of the present invention. The RFID reader antenna 200 is composed of a transmission antenna 210 and a reception antenna 220 in a ground body. The radiating bodies 210 and 220 are circular polarization patches using a dual feed method and they are fed by using quadrature hybrid couplers 230 and 240.

Herein, two feed points of the transmission antenna 210 are marked as a 211 and b 212, whereas two feed points of the reception antenna 220 are marked as c 221 and d 222. The feed points a 211 and b 212 are fed by a transmission coupler 230, and the feed points c 221 and d 222 are fed by a reception coupler 240.

Also, the transmission coupler 230 supplying signals to the two feed points a and b of the transmission antenna 210 includes two transmission ports $T_1$ 231 and $T_2$ 232. The reception coupler 240 acquiring signals from the two feed points c and d of the reception antenna 220 includes two reception ports $R_1$ 241 and $R_2$ 242.

Power inputted to the transmission ports $T_1$ 231 and $T_2$ 232 of the transmission coupler 230 is delivered to the feed points a 211 and b 212 of the transmission antenna 210 at the same magnitude but with the phase shifted by 90° to thereby generate circular polarization in the transmission antenna 210. When the port $T_1$ 231 is used as a transmission port, the transmission antenna 210 generates a right hand circular polarization (RHCP). When the port $T_2$ 232 is used as a transmission port, the transmission antenna 210 generates a left hand circular polarization (LHCP). Herein, the port that is not used should have a load matched to a port impedance.

Meanwhile, when the reception coupler 240 uses the port $R_1$ 241 as a reception port, the reception antenna 220 receives the LHCP. When the reception coupler 240 uses the port $R_2$ 242 as a reception port, the reception antenna 220 receives the RHCP.

Figure 3:
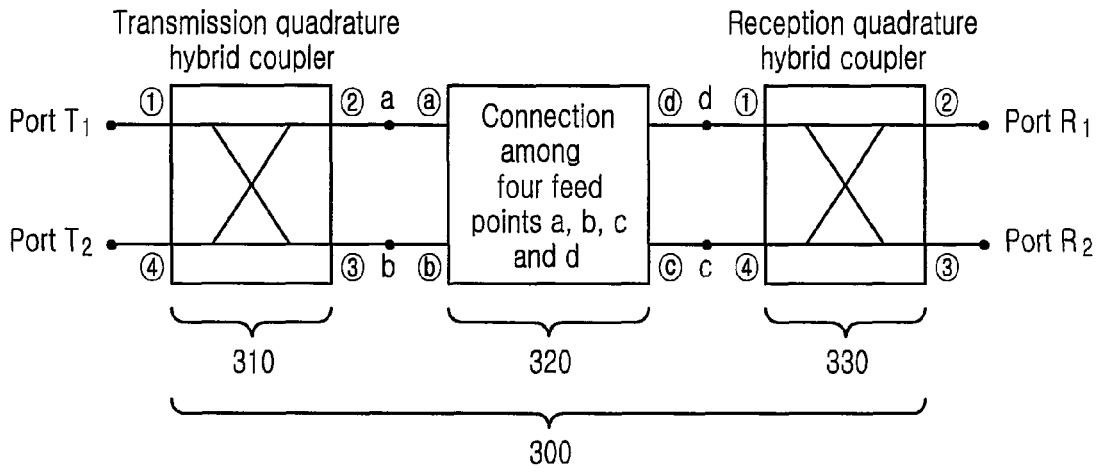
FIG. 3 is a schematic view showing an equivalent circuit of FIG. 2.
Figure 4:
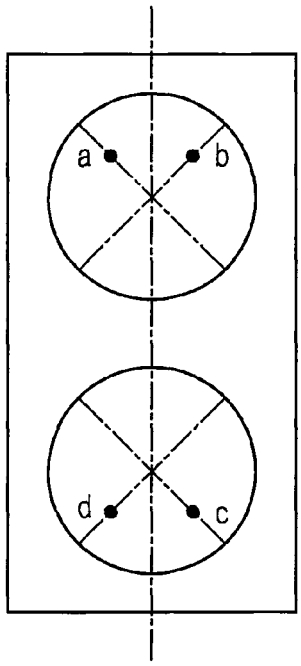
FIGS. 4 to 8 are views describing a reader antenna satisfying $S_{da}=S_{cb}$ and $S_{ca}=S_{db}$.
Figure 5:
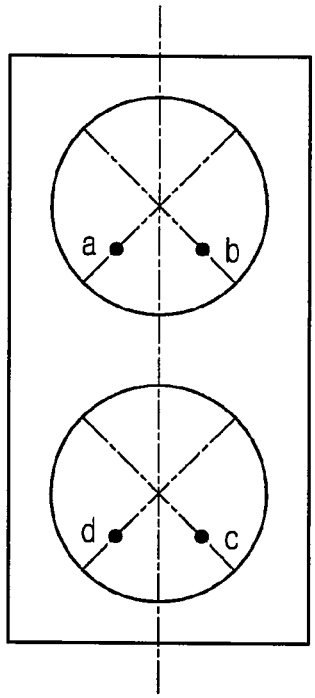
Figure 6:
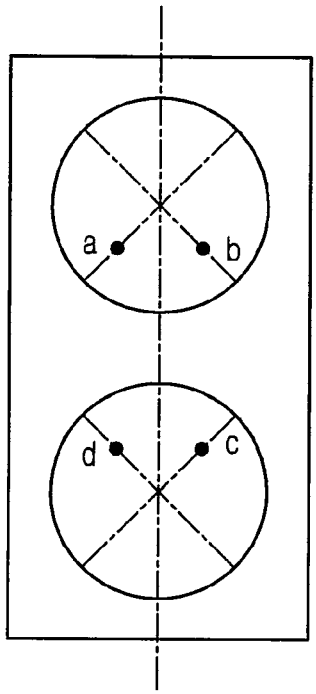
Figure 7:
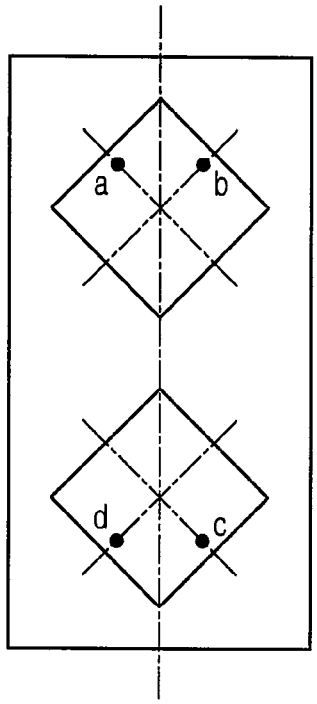
Figure 8:
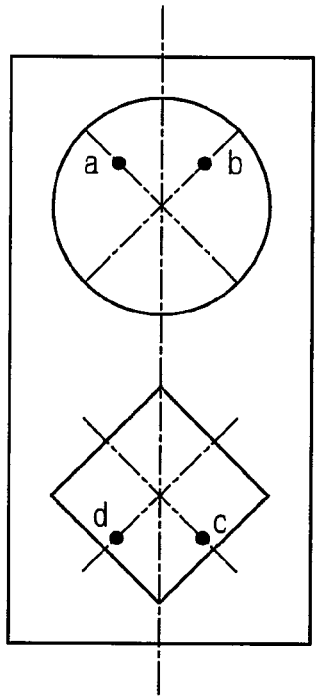

FIG. 3 is a schematic view showing an equivalent circuit of FIG. 2. The equivalent circuit serially connects a transmission equivalent 4-port network 310 of the transmission coupler 230, a reception equivalent 4-port network 330 of the reception coupler 240, and an equivalent 4-port network 320 connecting four feed points a, b, c and d. Reference number 300 denotes the entire circuit network. $T_1$ and $T_2$ denote transmission ports and $R_1$ and $R_2$ represent reception ports. The feed points of network 320 are denoted ⓐ, ⓑ, ⓒ, and ⓓ. The network 310 employs a transmission guadrature hybrid coupler and the network 330 employs a reception quadrature hybrid coupler. The network 320 represents connections or coupling among the four feed points a, b, c, and d.

All the ports ①, ②, ③ and ④ of the two couplers 310 and 330 are matched. Power inputted to the port ① is delivered to the ports ② and ③ at the same magnitude but shifted in phase by 90°, but it is not delivered to the port ④. Thus, a scattering matrix $S^C$ of the two couplers 310 and 330 is expressed as shown in Equation 1.

$$[S^C] = \begin{pmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{pmatrix} = \frac{-1}{\sqrt{2}} \begin{pmatrix} 0 & j & 1 & 0 \\ j & 0 & 0 & 1 \\ 1 & 0 & 0 & j \\ 0 & 1 & j & 0 \end{pmatrix} \quad \text{Eq. 1}$$

In the Equation 1, $S_{ij}$ denotes a ratio of a signal inputted to a port i and a signal outputted from a port j. $S_{ij}$ becomes a reflection coefficient when the ports i and j are the same (i=j). When the ports i and j are not the same (i≠j), $S_{ij}$ denotes a transmission coefficient from the port j to the port i. A scattering matrix and a scattering matrix (i.e., Equation 1) of the quadrature hybrid coupler are described in detail by D. M. Pozar in "Microwave Engineering," Addison-Wesley Publishing Company, pp. 220-231 and pp. 441-412, 1990.

A scattering matrix $S^M$ of the equivalent 4-port network 320 showing connection among the four feed points a, b, c and d is expressed as shown in Equation 2, when all the ports ①, ②, ③ and ④ are matched.

$$[S^M] = \begin{pmatrix} S_{aa} & S_{ab} & S_{ac} & S_{ad} \\ S_{ba} & S_{bb} & S_{bc} & S_{bd} \\ S_{ca} & S_{cb} & S_{cc} & S_{cd} \\ S_{da} & S_{db} & S_{dc} & S_{dd} \end{pmatrix} = \begin{pmatrix} 0 & S_{ab} & S_{ac} & S_{ad} \\ S_{ba} & 0 & S_{bc} & S_{bd} \\ S_{ca} & S_{cb} & 0 & S_{cd} \\ S_{da} & S_{db} & S_{dc} & 0 \end{pmatrix} \quad \text{Eq. 2}$$

In Equation 2, $S_{pq}$ denotes the ratio of a signal inputted to a port p and a signal outputted from a port q, where p and q are the feed points a, b, c, and d. $S_{pq}$ becomes a reflection coefficient when the ports p and q are the same (p=q). When the ports p and q are not the same (p≠q), $S_{pq}$ denotes a transmission coefficient from the port q to the port p.

Meanwhile, a scattering matrix $S^T$ of the entire circuit network 300 connecting the transmission coupler 310, the equivalent 4-port network 320, and the reception coupler 330 in FIG. 3 is expressed as shown in Equation 3.

$$[S^T] = \begin{pmatrix} S_{T_1T_1} & S_{T_1T_2} & S_{T_1R_1} & S_{T_1R_2} \\ S_{T_2T_1} & S_{T_2T_2} & S_{T_2R_1} & S_{T_2R_2} \\ S_{R_1T_1} & S_{R_1T_2} & S_{R_1R_1} & S_{R_1R_2} \\ S_{R_2T_1} & S_{R_2R_2} & S_{R_2R_1} & S_{R_2R_2} \end{pmatrix} \quad \text{Eq. 3}$$

In Equation 3, $S_{xy}$ denotes the ratio of a signal inputted to a port x and a signal outputted from a port y, where x and y are the transmission ports $T_1$ and $T_2$, and the reception ports $R_1$ and $R_2$. $S_{xy}$ becomes a reflection coefficient when the ports x and y are the same (x=y). When the ports x and y are not the same (x≠y), $S_{xy}$ denotes a transmission coefficient from the port y to the port x. In the Equation 3, a transmission coefficient $S_{R_1T_1}$ from the port $T_1$ to the port $R_1$ and a transmission coefficient $S_{R_2T_1}$ from the port $T_1$ to the port $R_2$ can be calculated based on a signal flow graph, and the results are as shown in Equations 4 and 5. The signal flow graph and a method of calculating a scattering matrix of a serial circuit network based on the signal flow graph are disclosed in detail by D. M. Pozar "Microwave Engineering," Addition-Wesley Publishing Company, pp. 245-250, 1990.

$$S_{R_1T_1} = -\frac{1}{2}(S_{da} - S_{cb}) + j\frac{1}{2}(S_{ca} + S_{db}) \quad \text{Eq. 4}$$

$$S_{R_2T_1} = -\frac{1}{2}(S_{ca} - S_{db}) + j\frac{1}{2}(S_{da} + S_{cb}) \quad \text{Eq. 5}$$

When $S_{da}=S_{cb}$ in the Equation 4, signals leaking from the feed point a 211 of the transmission antenna 210 to the feed point d 222 of the reception antenna 220 are offset by signals leaking from the feed point b 212 of the transmission antenna 210 to the feed point c 221 of the reception antenna 220 in FIG. 2. Thus, the degree of isolation between the transmission port $T_1$ 231 and the reception port $R_1$ 241, which is an inverse number of the transmission coefficient, i.e., $-20\log|S_{R_1T_i}|$ [dB], can be improved.

Also, when $S_{ca}=S_{db}$ in the Equation 5, signals leaking from the feed point a 211 of the transmission antenna 210 to the feed point c 221 of the reception antenna 220 are offset by signals leaking from the feed point b 212 of the transmission antenna 210 to the feed point d 222 of the reception antenna 220 in FIG. 2. Thus, the isolation degree between the transmission port $T_1$ 231 and the reception port $R_2$ 242, $-20\log|S_{R_2T_1}|$, can be improved.

When a transmission coefficient is designed to satisfy $S_{da}=S_{cb}$ and $S_{ca}=S_{db}$ at the same time, the $S_{R_1T_1}$ and the $S_{R_2T_1}$ are as shown in Equations 6 and 7.

$$|S_{R_1T_1}|=|S_{ca}| \quad \text{Eq. 6}$$

$$|S_{R_2T_1}|=|S_{da}| \quad \text{Eq. 7}$$

The meaning of the Equations 6 and 7 will be described hereinafter with reference to FIG. 2.

The equation 6 signifies that the isolation degree between the port $T_1$ 231 and the port $R_1$ 241 in the reader antenna 200 is the same as the isolation degree between the feed point a 211 of the transmission antenna 210 and the feed point c 222 of the reception antenna 220. The equation 7 signifies that the isolation degree between the port $T_1$ 231 and the port $R_2$ 242 in the reader antenna 200 is the same as the isolation degree between the feed point a 211 of the transmission antenna 210 and the feed point d 221 of the reception antenna 220.

Figure 11:
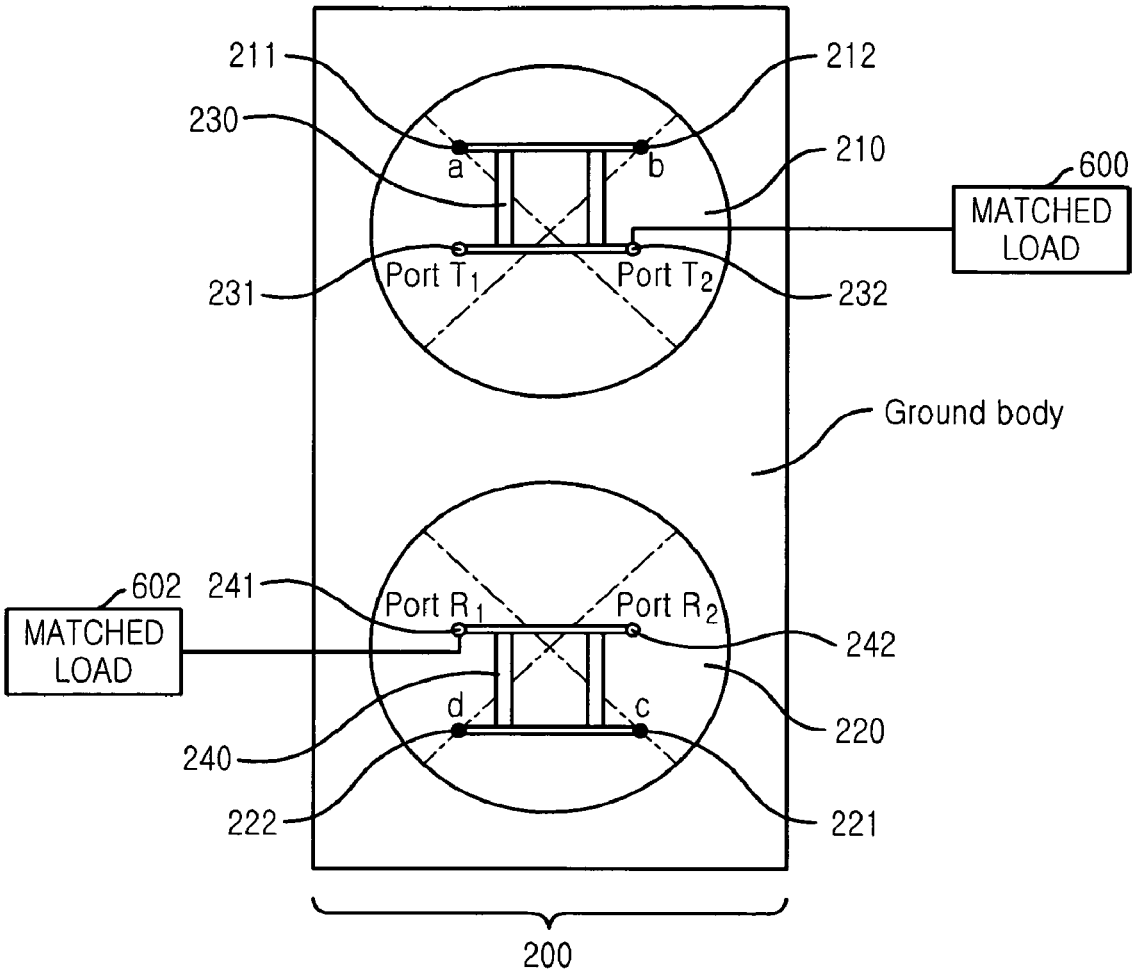
FIG. 11 shows the RFID antenna of FIG. 2, with unused ports terminated by matched loads.

Therefore, to acquire a reader antenna 200 having a high isolation between a transmission part and a reception part, the transmission and reception radiating bodies and the feed points are designed to have a minimum min[$|S_{da}|$,$|S_{ca}|$] while $S_{da}=S_{cb}$ and $S_{ca}=S_{db}$. Then, when $|S_{da}|<|S_{ca}|$, the port $T_1$ 231 and the port $R_2$ 242 are used as a transmission port and a reception port, respectively. The other unused ports $T_2$ and $R_1$ 232 and 241 have a matched load. Such an arrangement is shown in FIG. 11, where matched loads 600 and 602 are coupled to the unused ports.

On the contrary, when $|S_{da}|>|S_{ca}|$, the port $T_1$ 231 and the port $R_1$ 241 are used as a transmission port and a reception port, respectively. The other unused ports $T_2$ and $R_2$ 232 and 242 have a matched load.

Meanwhile, when a transmission coefficient $S_{R_2T_2}$ from the port $T_2$ to the port $R_1$ and a transmission coefficient $S_{R_2T_2}$ from the port $T_2$ to the port $R_2$ are calculated based on a signal flow graph, they are as shown in Equations 8 and 9.

$$S_{R_1T_2} = \frac{1}{2}(S_{ca} - S_{db}) + j\frac{1}{2}(S_{da} + S_{cb}) \quad \text{Eq. 8}$$

$$S_{R_2T_2} = \frac{1}{2}(S_{da} - S_{cb}) + j\frac{1}{2}(S_{ca} + S_{db}) \quad \text{Eq. 9}$$

In the Equation 8, when $S_{ca}=S_{db}$, a signal leaking from the feed point a 211 of the transmission antenna 210 to the feed point c 221 of the reception antenna 220 is offset by a signal leaking from the feed point b 212 of the transmission antenna 210 to the feed point d 222 of the reception antenna 220. Thus, the isolation between the transmission port $T_2$ 232 and the reception port $R_1$ 241, i.e., $-20\log|S_{R_1T_2}|$[dB], can be improved.

Also, in the Equation 9, when $S_{da}=S_{cb}$, a signal leaking from the feed point a 211 of the transmission antenna 210 to the feed point d 222 of the reception antenna 220 is offset by a signal leaking from the feed point b 212 of the transmission antenna 210 to the feed point c 221 of the reception antenna 220. Thus, the isolation between the transmission port $T_2$ 232 and the reception port $R_2$ 242, i.e., $-20\log|S_{R_2T2}|$, can be improved.

When a reader antenna is designed to simultaneously satisfy both $S_{da}=S_{cb}$ and $S_{ca}=S_{db}$, the following Equations 10 and 11 are acquired from the Equations 6 to 9.

$$|S_{R_1T_2}|=|S_{R_2T_1}|=|S_{da}| \quad \text{Eq. 10}$$

$$|S_{R_2T_2}|=|S_{R_1T_1}|=|S_{ca}| \quad \text{Eq. 11}$$

In short, when $S_{da}=S_{cb}$ and $S_{ca}=S_{db}$, the isolation degree between the port $T_2$ 232 and the port $R_1$ 241 is the same as the isolation degree between the port $T_1$ 231 and the port $R_2$ 242, and the isolation degree between the port $T_2$ 232 and the port $R_2$ 242 is the same as the isolation degree between the port $T_1$ 231 and the port $R_1$ 241.

To sum up, in order to provide a reader antenna 200 with a high isolation degree, the structure of the transmission and reception radiating bodies and the position of the feed points should be designed to have a minimum min[$|S_{da}|$,$|S_{ca}|$] while $S_{da}=S_{cb}$ and $S_{ca}=S_{db}$. Then, $|S_{da}|$ and $|S_{ca}|$ are compared with each other.

When $|S_{da}|<|S_{ca}|$ and the port $T_1$ 231 is used as a transmission port, the port $R_2$ 242 is used as a reception port and the two unused ports $T_2$ and $R_1$ 232 and 241 have a matched load attached thereto. When the port $T_2$ 232 is used as a transmission port, the port $R_1$ 241 is used as a reception port and the two unused ports $T_1$ and $R_2$ 231 and 242 have a matched load attached thereto.

On the contrary, when $|S_{da}|>|S_{ca}|$ and the port $T_1$ 231 is used as a transmission port, the port $R_1$ 241 is used as a reception port and the two unused ports $T_2$ and $R_2$ 232 and 242 have a matched load attached thereto. When the port $T_2$ 232 is used as a transmission port, the port $R_2$ 242 is used as a reception port and the two unused ports $T_1$ and $R_1$ 231 and 241 have a matched load attached thereto.

FIGS. 4 to 8 present diverse examples of reader antennas which satisfy $S_{da}=S_{cb}$ and $S_{ca}=S_{db}$. In these drawings, a and b denote the transmission feed points and c and d denote the reception feed points. As for the radiating bodies used in the present invention, diverse structures of patches known to those skilled in the art of the present invention can be used such as a square patch and a circular patch.

Also, the feeding method of the radiating bodies in the reader antennas shown in FIGS. 2 and 4 to 8 adopt a direct feeding method. However, diverse feeding methods known to those skilled in the art, which include aperture coupling and proximity coupling, may be used. This will be described hereafter with reference to FIG. 5.

Figure 9:
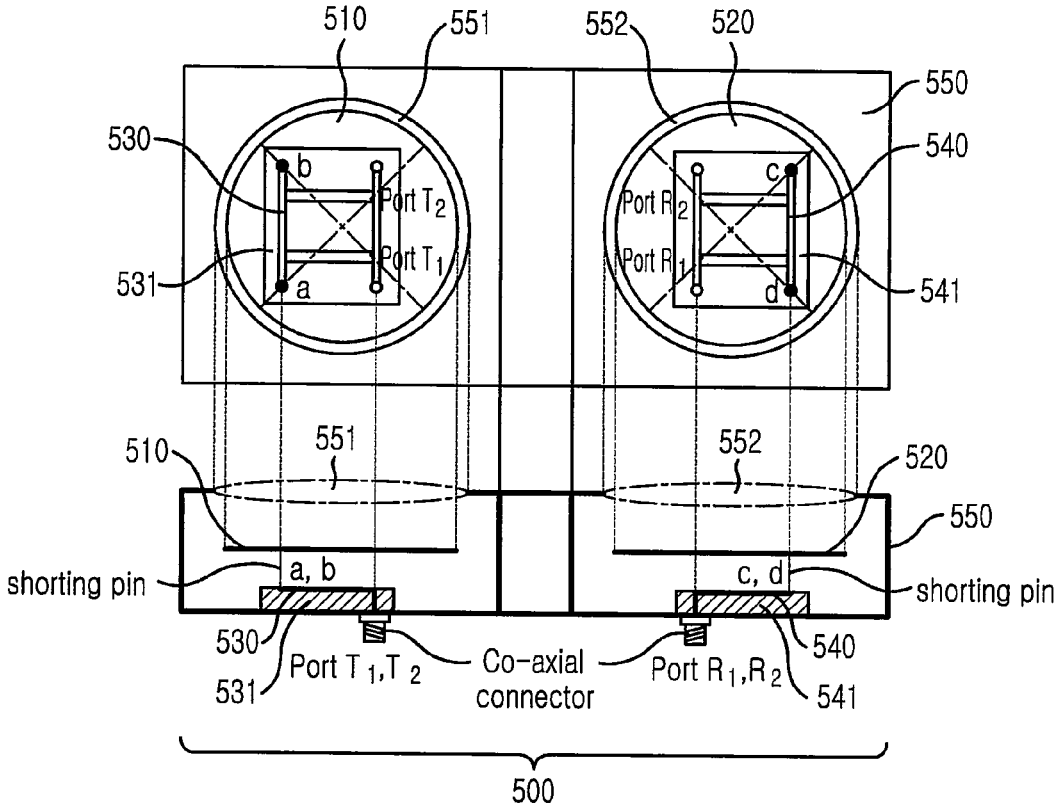
FIG. 9 is a schematic view depicting a reader antenna in accordance with an embodiment of the present invention.

FIG. 9 is a schematic view depicting a reader antenna 500 in accordance with an embodiment of the present invention. As illustrated in FIG. 9, circular patches are used as a transmission antenna 510 and a reception antenna 520. A transmission coupler 530 and a reception coupler 540 are designed in the form of microstrip lines on dielectric substrates 531 and 541 and they are interposed between the transmission and reception radiating bodies 510 and 520 and a ground body 550. Herein, the space between the transmission and reception radiating bodies 510 and 520 and the ground body 550 is filled with air.

The ground body 550 is designed in the form of a cavity surrounding the transmission and reception radiating bodies 510 and 520. In other words, the transmission and reception radiating bodies 510 and 520 are positioned in the ground body 550, which is formed in the shape of a metal box, and apertures 551 and 552 of a predetermined size are formed in the direction of a main beam of the transmission and reception radiating bodies 510 and 520.

Herein, the reader antenna of FIG. 9 adopts direct feeding. In short, power inputted to the ports $T_1$ and $T_2$, which are formed of a co-axial connector, is delivered to the feed points a and b of the transmission antenna 510 through a transmission coupler 530 and a shorting pin in the same size but with a phase shifted by 90° to thereby generate circular polarization in the transmission antenna 510. When the port $T_1$ is used as a transmission port, the transmission antenna 510 generates a right hand circular polarization. When the port $T_2$ is used as a transmission port, the transmission antenna 510 generates a left hand circular polarization.

Meanwhile, RF signals are received through the feed points c and d of the reception antenna 520 and the RF signals are delivered to the ports $R_1$ and $R_2$ of the reception coupler 240 through the shorting pin. When the port $R_1$ is used as a reception port, the reception antenna 520 receives a left hand circular polarization. When the port $R_2$ is used as a reception port, the reception antenna 520 receives a right hand circular polarization.

Meanwhile, although the reader antenna of FIG. 9 uses a direct feeding method for the transmission and reception radiating bodies, diverse kinds of feeding methods known to those skilled in the art of the present invention, which include aperture coupling and proximity coupling, may be used in the present invention.

Aperture coupling is a feeding method for electrically connecting the transmission and reception radiating bodies 510 and 520 to the transmission and reception couplers 530 and 540 by not connecting the two feed points (a,b) and (c,d) of the transmission and reception radiating bodies 510 and 520 with the two ports ($T_1$, $T_2$) and ($R_1$, $R_2$) of the transmission and reception couplers 530 and 540 through the shorting pin, positioning the ground body between the transmission and reception radiating bodies 510 and 520 and the transmission and reception couplers 530 and 540, and forming an aperture in the ground body in a predetermined shape. The aperture coupling feeding is disclosed in detail in a paper by Marcel Kossel, entitled "Circularly Polarized, Aperture-coupled Patch Antennas for a 2.4 GHz RFID System," Microwave Journal, November 1999.

Proximity coupling is a feeding method for connecting two feed points (a,b) and (c,d) of the transmission and reception radiating bodies 510 and 520 with the two ports ($T_1$, $T_2$) and ($R_1$, $R_2$) of the transmission and reception couplers 530 and 540 through capacitive coupling, instead of connecting the two feed points (a,b) and (c,d) of the transmission and reception radiating bodies 510 and 520 with the two ports ($T_1$, $T_2$) and ($R_1$, $R_2$) of the transmission and reception couplers 530 and 540 through a shorting pin.

Proximity coupling feeding is disclosed in detail in a paper by D. M. Pozar, entitled "Increasing the bandwidth of a microstrip antenna by proximity coupling," Electronics Letters, Vol. 23, No. 8, April 1987.

Figure 10:
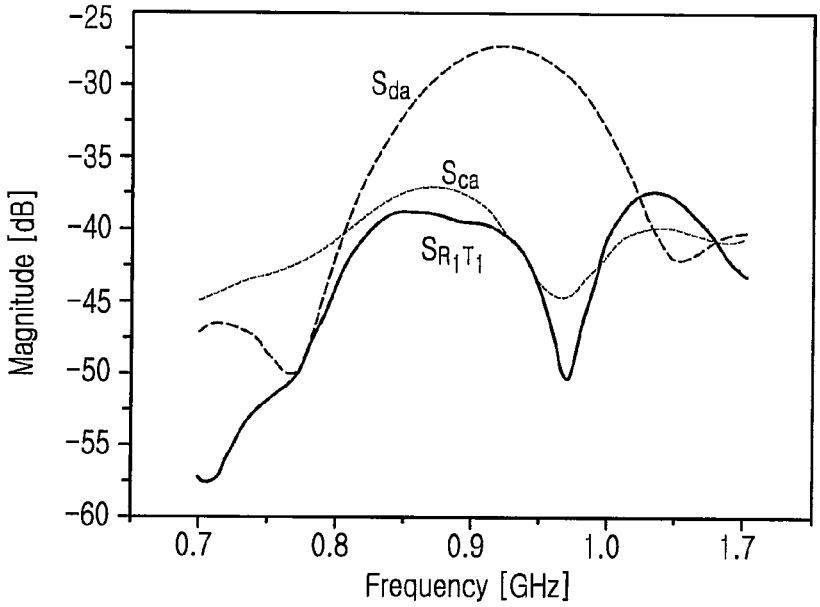
FIG. 10 is a graph showing a frequency function representing $|S_{ca}|$ and $|S_{da}|$.

FIG. 10 is a graph showing a frequency function (with the frequency in GHz representing $|S_{ca}|$ and $|S_{da}|$. The ordinate axis in FIG. 10 represents magnitude, in decibels. Herein, the size of the ground body 550 is 200 mm×450 mm×34 mm, and the diameter of the circular patch is 160 mm.

It can be seen from FIG. 10 that $|S_{da}|<|S_{ca}|$ at an operating frequency ranging from 900 to 930 MHz. Thus, when the port $T_1$ 231 is determined as a transmission port and the port $R_1$ 241 is determined as a reception port, the isolation degree $-20\log|S_{R_1T_1}|$[dB] between the two ports is given to be more than about 38 dB, which is shown in FIG. 10.

While the present invention has been described with respect to certain preferred embodiments, it will be apparent to those skilled in the art that various changes and modifications may be made without departing from the scope of the invention as defined in the following claims.

The technology of the present invention can be applied to an antenna with a transmission part and a reception part isolated from each other in a Radio Frequency Identification (RFID) system.

What is claimed is:

1. An antenna system with a transmission part and a reception part highly isolated from each other, comprising:

a transmission antenna for transmitting signals, the transmission antenna having a first feed point a and a second feed point b;

a reception antenna for receiving signals, the reception antenna having a first feed point c and a second point d;

a transmission hybrid coupler which is connected to the first feed point a and the second feed point b of the transmission antenna and transmits transmission signals which have a phase difference of 90° from each other; and a reception hybrid coupler which is connected to the first feed point c and the second feed point d of the reception antenna and receives reception signals which have a phase difference of 90° from each other, wherein a transmission coefficient from any one of the first feed point a and the second feed point b of the transmission antenna to any one of the first feed point c and the second feed point d of the reception antenna is substantially the same as a transmission coefficient from the other of the first feed point a and the second feed point b of the transmission antenna to the other of the first feed point c and the second feed point d of the reception antenna, so that signals leaking from the feed points a and b of the transmission antenna to the feed points c and d of the reception antenna are offset.

2. The antenna system as recited in claim 1, further comprising:

a ground body of a cavity structure which has apertures in main beam directions of the transmission and reception antennas and partially surrounds the transmission and reception antennas.

3. The antenna system as recited in claim 1, wherein the transmission coefficient from the first feed point a to the second feed point d is substantially the same as the transmission coefficient from the second feed point b to the first feed point c with respect to an equivalent 4-port network scattering coefficient, which represents coupling among the first feed points a and c and the second feed points b and d.

4. The antenna system as recited in claim 3, wherein the transmission hybrid coupler includes two ports $T_1$ and $T_2$ for supplying transmission signals respectively to the first feed point a and the second feed point b of the transmission antenna, and the reception hybrid coupler includes two ports $R_1$ and $R_2$ for receiving reception signals respectively from the first feed point c and the second feed point d of the reception antenna, and a transmission coefficient from the port $T_1$ to the port $R_2$ is substantially the same as a transmission coefficient from the port $T_2$ to the port $R_1$ with respect to an equivalent 4-port network scattering coefficient composed of the four ports $T_1$, $T_2$, $R_1$ and $R_2$.

5. The antenna system as recited in claim 4, wherein when the port $T_1$ is used as a transmission port, the port $R_2$ is used as a reception port; and when the port $T_2$ is used as a transmission port, the port $R_1$ is used as a reception port.

6. The antenna system as recited in claim 5, wherein the ports $T_2$ and $R_1$ are unused ports when the port $T_1$ is used as the transmission port and the ports $T_1$ and $R_2$ are unused ports when the port $T_2$ is used as the transmission port, and wherein the unused ports of the couplers include matched loads attached thereto.

7. The antenna system as recited in claim 1, wherein the transmission coefficient from the first feed point a to the first feed point c is substantially the same as the transmission coefficient from the second feed point b to the second feed point d with respect to an equivalent 4-port network scattering coefficient, which represents coupling among the first feed points a and c and the second feed points b and d.

8. The antenna system as recited in claim 7, wherein the transmission hybrid coupler includes two ports $T_1$ and $T_2$ for supplying transmission signals respectively to the first feed point a and the second feed point b of the transmission antenna, and the reception hybrid coupler includes two ports $R_1$ and $R_2$ for receiving reception signals respectively from the first feed point c and the second feed point d of the reception antenna, and a transmission coefficient from the port $T_1$ to the port $R_1$ is substantially the same as a transmission coefficient from the port $T_2$ to the port $R_2$ with respect to an equivalent 4-port network scattering coefficient composed of the four ports $T_1$, $T_2$, $R_1$ and $R_2$.

9. The antenna system as recited in claim 8, wherein when the port $T_1$ is used as a transmission port, the port $R_1$ is used as a reception port; and when the port $T_2$ is used as a transmission port, the port $R_2$ is used as a reception port.

10. The antenna system as recited in claim 9, wherein the ports $T_2$ and $R_2$ are unused ports when the port $T_1$ is used as a transmission port and the ports $T_1$ and $R_1$ are unused ports when the port $T_2$ is used as the transmission port, and wherein the unused ports of the couplers include a matched load attached thereto.

11. The antenna system as recited in claim 1, wherein the transmission coefficient from the feed first point a to the second feed point d is substantially the same as the transmission coefficient from the second feed point b to the first feed point c with respect to an equivalent 4-port network scattering coefficient, which represents coupling among the first feed point a and c and the second feed points b and d.

12. The antenna system as recited in claim 11, wherein the transmission hybrid coupler includes two ports $T_1$ and $T_2$ for supplying transmission signals respectively to the first feed point a and the second feed point b of the transmission antenna, and the reception hybrid coupler includes two ports $R_1$ and $R_2$ for receiving reception signals respectively from the first feed point c and the second feed point d of the reception antenna, and a transmission coefficient from the port $T_1$ to the port $R_2$ is substantially the same as a transmission coefficient from the port $T_2$ to the port $R_1$ and a transmission coefficient from the port $T_1$ to the port $R_1$ is substantially the same as a transmission coefficient from the port $T_2$ to the port $R_2$ with respect to an equivalent 4-port network scattering coefficient composed of the ports $T_1$, $T_2$, $R_1$ and $R_2$.

13. The antenna system as recited in claim 12, wherein the transmission coefficient from the port $T_1$ to the port $R_2$ is larger than the transmission coefficient from the port $T_1$ to the port $R_1$, and wherein a pair of a transmission port and a reception port is selected from the group consisting of a pair of the transmission port $T_1$ and the reception port $R_1$ and a pair of the transmission port $T_2$ and the reception port $R_2$.

14. The antenna system as recited in claim 12, wherein the transmission coefficient from the port $T_1$ to the port $R_2$ is smaller than the transmission coefficient from the port $T_1$ to the port $R_1$, and wherein a pair of a transmission port and a reception port is selected from the group consisting of a pair of the transmission port $T_1$ and the reception port $R_2$ and a pair of the transmission port $T_2$ and the reception port $R_1$.

15. An antenna system with a transmission part and a reception part highly isolated from each other, comprising:

transmission and reception antennas for providing signal transmission and reception, respectively, the transmission antenna having two feed points a and b and the reception antenna having two feed points c and d; and transmission and reception hybrid couplers for dual feeding to the transmission and reception antennas, respectively, wherein a transmission coefficient from any one of the feed point a and the feed point b of the transmission antenna to any one of the feed point c and the feed point d of the reception antenna is substantially the same as a transmission coefficient from the other of the feed points a and b of the transmission antenna to the other of the feed points c and d of the reception antenna, so that signals leaking from the two feed points a and b of the transmission antenna to the two feed points c and d of the reception antenna are offset by each other.

16. The antenna system as recited in claim 15, wherein each of the antennas is any one selected from the group consisting of a circular patch, a square patch, and a polygonal patch.

17. The antenna system as recited in claim 15, wherein the transmission hybrid coupler includes two ports for supplying transmission signals to the two feed points a and b of the transmission antenna, respectively, and the reception hybrid coupler includes two ports for receiving reception signals to the two feed points c and d of the reception antenna, respectively, and wherein a transmission coefficient from any one port between the two ports of the transmission hybrid coupler to any one port between the two ports of the reception hybrid coupler is substantially the same as a transmission coefficient from the other port of the transmission hybrid coupler to the other port of the reception hybrid coupler.

18. The antenna system as recited in claim 15, wherein the dual feeding is direct feeding.

* * * * *